United States Patent [19]

Canaris

[11] 4,162,947

[45] Jul. 31, 1979

[54] ACID ZINC PLATING BATHS AND METHODS FOR ELECTRODEPOSITING BRIGHT ZINC DEPOSITS

[75] Inventor: Valerie M. Canaris, Parma, Ohio

[73] Assignee: R. O. Hull & Company, Inc., Cleveland, Ohio

[21] Appl. No.: 908,567

[22] Filed: May 22, 1978

[51] Int. Cl.[2] ..... C25D 3/22

[52] U.S. Cl. ..... 204/55 R; 204/DIG. 2

[58] Field of Search ..... 204/55 R, 43 Z, DIG. 2

[56] References Cited

U.S. PATENT DOCUMENTS

| | | | |
|---|---|---|---|
| 3,723,263 | 3/1973 | Rosenberg | 204/55 R |
| 3,855,085 | 12/1974 | Rushmere | 204/55 R |
| 3,878,069 | 4/1975 | Todt et al. | 204/55 R |
| 4,075,066 | 2/1978 | Eckles et al. | 204/55 R |
| 4,089,755 | 5/1978 | Steinecker | 204/55 R |
| 4,119,502 | 10/1978 | Arcilesi | 204/55 R |

*Primary Examiner*—G. L. Kaplan

*Attorney, Agent, or Firm*—Maky, Renner, Otto & Boisselle

[57] ABSTRACT

An aqueous acidic plating bath for the electrodeposition of a bright zinc deposit on a substrate is disclosed and comprises zinc ions, ammonium ions and at least one aromatic sulfonic acid or salt having the general formula

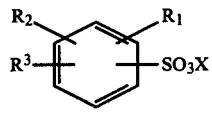

I or

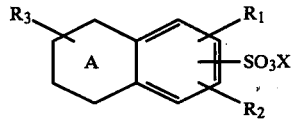

II wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring.

Additionally, the plating baths of the invention may contain aromatic carbonyl-containing compounds and particularly aromatic aldehydes containing at least one halogen substituent. Polyoxyalkylated naphthols and polyalkylene glycol ethers as well as poly(alkyleneimines) also are contemplated as being useful in the plating baths of the invention. Methods for depositing a bright zinc coating over a wide range of current densities, and additive compositions for preparing plating baths useful in these methods also are described.

20 Claims, No Drawings

ACID ZINC PLATING BATHS AND METHODS FOR ELECTRODEPOSITING BRIGHT ZINC DEPOSITS

BACKGROUND OF THE INVENTION

The invention relates to the electrodeposition of zinc, and particularly to a plating bath for plating bright level zinc deposits from aqueous acid plating baths. More particularly, the invention relates to the incorporation in the acid zinc baths of at least one bath-soluble aromatic sulfonic acid or salt wherein the aromatic group preferably contains one or more lower alkyl group. The invention also relates to methods for electrodeposition of level and bright zinc deposits from such baths.

Considerable attention has been directed over the years to the development of zinc electroplating baths which will produce bright and level deposits of improved quality. Much research has been devoted to improving the overall brightness, the range of allowable current densities, and ductility of the zinc deposit. Until recently, most of the successful zinc plating baths were aqueous alkaline zinc plating baths containing substantial quantities of cyanide which has caused concern regarding toxicity and waste disposal problems.

Accordingly, activity in the plating area has been devoted either to the development of cyanide-free alkaline plating baths or improvements in acid plating baths. This invention relates to acid plating baths.

Typically, acid plating baths have been based on a suitable inorganic zinc salt such as zinc sulfate, and the baths usually include buffers such as the corresponding ammonium salt and other additives to promote and improve ductility, brightness, throwing power and covering power. Surface active agents may be included to improve crystal structure, reduce pitting, and increase the solubility of the other additives.

U.S. Pat. No. 4,076,600 is an example of a patent relating to acid zinc plating baths and the invention therein relates to the use of compositions containing phosphorus cations as leveling agents. The baths also may contain small amounts of nitrogen-containing compounds obtained by reacting (a) ammonia, an aliphatic amine containing at least one primary amine group, or mixtures of two or more of any of these with (b) one or more epihalohydrins, glycerol halohydrins or mixtures thereof. The use of bath-soluble reaction products obtained by the reaction of a nitrogen-containing heterocyclic compound with an acyclic amine having at least two functional groups separated by at least one different group, formaldehyde and an epihalohydrin of glycerol halohydrin in alkaline zinc electroplating baths is described in U.S. Pat. Nos. 3,655,534 and 3,849,325.

Aromatic carbonyl-containing compounds generally are incorporated into acid zinc baths as a supplemental brightener additive and for improving the fineness of the grain of the zinc deposit. Wetting agents or surfactants have been added to these baths to solubilize or improve the solubility of the carbonyl-containing compounds in the bath, but such wetting agents and surfactants generally result in a bath exhibiting a tendency to foam excessively, particularly on agitation and at the higher current densities often used in zinc plating.

U.S. Pat. No. 4,075,066 describes ammonia free zinc plating baths containing polyoxyalkylated naphthols, aromatic carboxylic acids or salts and at least one aromatic sulfonic acid or salt. A variety of aromatic sulfonic acids are suggested and one group of these are the water soluble salts of tetrahydronaphthalene sulfonic acid.

SUMMARY OF THE INVENTION

The present invention relates to the discovery that a bright and level zinc electrodeposit can be obtained over a wide current density range from aqueous acid plating baths containing zinc ions and ammonium ions by including in the bath, an effective amount of at least one aromatic sulfonic acid or salt having the general formula

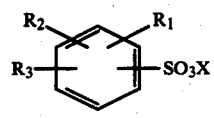

I or

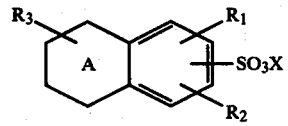

II wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring.

In addition to the above compounds, the acid zinc plating baths of the invention may contain aromatic carbonyl-containing compounds, poly(alkyleneimine) compounds, and polyether compounds such as polyoxyalkylated naphthols and polyalkylene glycol ethers.

DESCRIPTION OF THE PREFERRED EMBODIMENTS

The compositions which have been found to be useful particularly in acid zinc plating baths for improving the properties of the plating bath and in providing an acid plating bath which is effective over a wide current density range are aromatic sulfonic acids or salts having the general formula

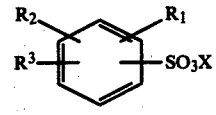

I or

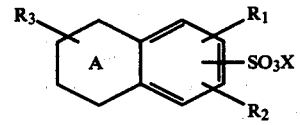

II wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring.

As can be seen from the formulas, the sulfonic acids may be derived from benzene sulfonic acids, naphthalene sulfonic acids and di or tetrahydronaphthalene sulfonic acids. The lower alkyl groups may be straight or branched chain and may contain up to about 6 carbon atoms. The aromatic sulfonic acids and salts of formulas I and II containing two alkyl groups have been found to be particularly effective in the acid zinc plating baths of the invention. Of the metals included in the salts of the sulfonic acids, the alkali metals, particularly sodium, are preferred.

Examples of aromatic sulfonic acids which are useful in the acid zinc plating baths of the invention include benzene sulfonic acid, toluene sulfonic acid, isopropylbenzene sulfonic acid, xylene sulfonic acid, diethylbenzene sulfonic acid, naphthalene sulfonic acid, methylnaphthalene sulfonic acid, dimethylnaphthalene sulfonic acid, tetrahydronaphthalene sulfonic acid, etc. The aromatic sulfonic acids preferably are added to the acid zinc plating baths in the form of their salts which may be metal salts or an ammonium salt. Any metal can be used to form the metal salts of the aromatic sulfonic acids so long as the metal does not cause any detrimental effects in the plating bath or render the sulfonates insoluble in the plating bath.

The aromatic sulfonic acids and salts which are utilized in the aqueous acid zinc plating baths of the invention generally are referred to in the art as hydrotropes. Hydrotropes have been defined as compounds which solubilize sparingly water-soluble compounds. The aromatic sulfonic acids and salts used in the present invention are effective in solubilizing sparingly water soluble materials such as aromatic carbonyl-containing compounds, and it has been found that the acid zinc plating baths containing the above described aromatic sulfonic acids and salts are not subject to excessive foaming during plating operations. This is in contrast to plating baths wherein wetting agents and surfactants are used to stabilize the baths since such plating baths generally are characterized by excess foaming on use which requires careful control of plating methods. The acid zinc plating baths of the invention, however, can be vigorously air agitated even at high current densities without excessive foaming.

The amount of aromatic sulfonic acid or salt incorporated into the acid zinc plating baths of the invention may vary over a wide range, and the optimum amount for any particular acid zinc plating bath combination can be determined readily by one skilled in the art. Generally, the amount of sulfonic acid or salt included in the plating baths of the invention will vary from about one to about 20 or more grams per liter of bath. Greater or lesser amounts of the sulfonic acid or salts can be included in the plating baths depending particularly on the water solubility characteristics of the additive desired to be included in the bath.

Mixtures of the aromatic sulfonic acids or salts appear to be particularly effective in the acid zinc plating baths of the invention. More particularly, mixtures comprising at least one sulfonic acid or salt represented by formula 1 and at least one sulfonic acid or salt represented by formula II are useful. An example of such a mixture is a mixture of sodium dimethylnaphthalene monosulfonate and sodium xylene monosulfonate.

The inclusion of the aromatic sulfonic acids and salts described above in acid zinc plating baths generally improves the performance of most acid zinc plating baths at a high current density range. Accordingly, the plating baths containing the sulfonic acids and salts of the invention are found to produce bright level zinc plating over a current density range of from below 0.3 amps/dm$^2$ to above 12 amps/dm$^2$.

The aqueous acidic zinc plating baths to which the sulfonic acid and salt compositions of the invention may be added include the conventional zinc and ammonium containing plating baths known to those skilled in the art. Such baths contain free zinc ions and are prepared with zinc sulfate, zinc chloride, zinc fluoborate and/or zinc sulphamate. The zinc plating baths also contain an ammonium compound such as ammonium chloride, ammonium fluoride and ammonium sulfate. Other conducting salts and boric acid can be used. Examples of conductive salts utilized in the acid zinc plating baths of the invention include sodium chloride and sodium fluoride. Boric acid which normally is included in the zinc plating baths of the invention serves as a weak buffer to control the pH and the cathode film. The boric acid also is helpful in smoothing the deposit and is believed to have a cooperative effect with the leveling agents of the invention. The concentration of boric acid in the bath is not critical and generally will be in the range of up to about 60 grams per liter. The inorganic salts of zinc may be present in the plating baths of the invention in amounts ranging from about 10 to about 150 grams per liter. The conductive salts such as the ammonium or sodium fluoride are present in amounts ranging from about 50 to about 300 grams per liter or more.

The acidity of the acid baths of the invention may vary from a pH of from about 1.5 to about 6 or 7. The pH may be lowered if desired by the addition of acid solutions such as 10% sulfuric acid solution. If the pH falls below the desired operating range, it can be increased by the addition of ammonium hydroxide or potassium hydroxide. Preferably the acid zinc baths are operated at a pH of from about 3 or 4 to about 6.5.

The acid zinc electroplating baths containing the aromatic sulfonic acid or salt compounds of the invention may be utilized to produce bright zinc deposits on all types of metals and alloys, for example, on iron, zinc die cast, copper and brass. The electroplating baths may be employed in all types of industrial zinc plating processes including still plating baths, high-speed plating baths for strip or wire plating, and in barrel plating.

The brightness of the zinc deposited from the aqueous acid plating baths containing the sulfonic or salt compounds of the invention may be improved if the bath also contains at least one aromatic carbonyl containing compound. The supplementary brighteners impart optimum leveling action over a wide plating range. The following compounds illustrate the types of aromatic carbonyl containing compounds which are useful as brighteners in the plating baths of the invention, and these carbonyl compounds include aldehydes as well as ketones: ortho-chlorobenzaldehyde, para-chlorobenzaldehyde, o-hydroxybenzaldehyde, aminobenzaldehyde, veratraldehyde, benzylidene acetone, coumarin, 3,4,5,6-tetrahydrobenzaldehyde, acetophenone, propiophenone, furfurylidine acetone, 3-methoxybenzal acetone, benzaldehyde, vanillin, hydroxybenzaldehyde, anisicaldehyde, benzoic acid, sodium benzoate, sodium salicylate, 3-pyridine carboxylic acid (nicotinic acid), etc. Mixtures of one or more of the aldehydes with one or more ketones also are useful. When employed in the baths of the invention, the carbonyl-containing brighteners will be included within the range of from about 0.02 to about 1 gram per liter and preferably from about 0.03 to about 0.5 gram per liter of bath.

Aromatic aldehydes containing at least one halogen substituent such as o-chlorobenzaldehyde are particularly useful. As mentioned earlier, such aldehydes are difficultly soluble in the plating baths and generally require the presence of wetting agents or surfactants to maintain the aldehydes in solution. Wetting agents and surfactants, however, increase the foaming tendency of the baths, especially if agitated during use. When the aromatic sulfonic acids and salt compounds of the invention are used in lieu of the wetting agents and surfactants, the tendency of the bath to foam is reduced significantly.

The properties of the zinc deposited from the aqueous acidic baths of the invention may be enhanced further by including in the bath, a small amount of one or more polyoxyalkylated naphthols which are obtained by reacting a naphthol with an alkylene oxide such as ethylene oxide and propylene oxide, and more particularly, with from about 6 to about 40 moles of ethylene oxide per mole of naphthol. The naphthol reactant may be either alpha or beta naphthol and the naphthalene ring may contain various substituents such as alkyl groups or alkoxy groups, especially lower alkyl and lower alkoxy groups of up to about 7 carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy group. The preferred polyoxyalkylated naphthols are ethoxylated naphthols having the formula

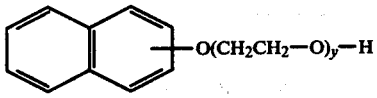

III wherein y is from about 6 to about 40 and preferably from about 8 to about 20. The amount of polyoxyalkylated naphthol included in the baths of the invention may vary within the range of from about 0.1 to about 20 grams or more per liter of bath.

Additive compounds based on ethylene and propylene oxide, for example, polyglycol compounds and the like, also are useful at levels of about 1 to 25 g/l and preferably at about 3–5 g/l of bath. In general, the nonionic wetting agents such as those containing ether linkages are particularly useful additives. Examples of such ether-containing wetting agents are those having the general formula $$R_7—O—[(CH_2)_nO]_xH \qquad IV$$

wherein $R_7$ is an aryl or alkyl group containing from about 6 to 20 carbon atoms, n is two or three, and x is an integer between 2 and 100. Such wetting agents are produced generally by treating fatty alcohols or alkyl-substituted phenols with excess ethylene oxide or propylene oxide. The alkyl carbon chain may contain from about 14 to 24 carbon atoms and may be derived from a long chain fatty alcohol such as oleyl alcohol or stearyl alcohol.

Nonionic polyoxyethylene compounds of this type, and their utility in acid zinc baths containing ammonium ions are described in U.S. Pat. No. 3,855,085. Such polyoxyethylene compounds are available commercially under the general trade designations "Surfynol" by Air Products and Chemicals, Inc. of Wayne, Pa., and under the designation "Pluronic" or "Tetronic" by BASF Wyandotte Corp. of Wyandotte, Mich. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L 35" is a product obtained by reacting 22 moles of ethylene oxide with polypropylene glycol obtained by the condensation of 16 moles of propylene glycol.

Carbowax-type wetting agents which are polyethylene glycols having different molecular weights have been found to give good results. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention.

Another useful component in the acid zinc baths of the invention are poly(alkyleneimines). These may be homopolymers of alkyleneimines or polymeric compositions obtained by reacting a poly(alkyleneimine) with cyclic carbonates.

The poly(alkyleneimines) which are useful in the present invention are derived from 1,2-alkyleneimines which may be represented by the general formula

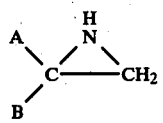

V wherein A and B may be each independently hydrogen or alkyl groups containing from one to about three carbon atoms. Where A and B are hydrogen, the compound is ethyleneimine. Compounds wherein either or both A and B are alkyl groups are referred to herein generically as alkyleneimines although such compounds have been referred to also as ethyleneimine derivatives wherein one or both hydrogens from the ethyleneimine are replaced with an alkyl group.

Examples of poly(alkyleneimines) which are useful in the present invention include polymers obtained from ethyleneimine, 1,2-propyleneimine, 1,2-butyleneimine and 1,1-dimethylethyleneimine. The poly(alkyleneimines) useful in the present invention may have molecular weights of from about 200 to about 100,000 or more although the higher molecular weight polymers are not generally as useful since they have tendency to be insoluble in the zinc plating baths of the invention. Preferably, the molecular weight will be within the range of from about 200 to about 60,000 and more preferably from about 300 to about 2,000. Poly(ethyleneimine) having a molecular weight of from about 300 to about 2,000 is a preferred example of a poly(alkyleneimine).

As mentioned above, the poly(alkyleneimines) may be used per se or may be reacted with a cyclic carbonate consisting of carbon, hydrogen and oxygen atoms. A description of the preparation of examples of such reaction products is found in U.S. Pat. No. 2,824,857, which disclosure is incorporated herein by reference. The cyclic carbonates further are defined as containing ring oxygen atoms adjacent to the carbonyl grouping which are each bonded to a ring carbon atom, and the ring containing said oxygen and carbon atoms has only three carbon atoms and no carbon-to-carbon unsaturation.

The cyclic carbonates which are useful in the preparation of the polymeric nitrogen-containing compounds of the invention may be a phenylene carbonate or a cyclic carbonate represented by the following formula VI

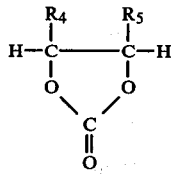

VI wherein $R_4$ and $R_5$ are each independently hydrogen, alkyl, $R_6OCH_2$—wherein $R_6$ is hydrogen or a monovalent hydrocarbon radical, and $R_4$ and $R_5$ taken together may represent an alkylene radical containing at least two carbon atoms.

An example of a cyclic carbonate wherein $R_4$ and $R_5$ are hydrogen is ethylene carbonate. Propylene carbonate is an example of a cyclic carbonate wherein $R_4$ is hydrogen and $R_5$ is a methyl group. Glycerol carbonate is an example of a cyclic carbonate wherein $R_4$ is hydrogen and $R_5$ is the HO—$H_2C$—group. Other examples of cyclic carbonates useful in the preparation of the polymeric compositions of the invention include allyl glycerol carbonate; 2,3-butylene carbonate; 3,4-hexylene carbonate; butylene carbonate; and carbonates wherein $R_4$ and $R_5$ taken together represent an alkylene radical such as —$CH_2CH_2$—; —$CH_2CH_2CH_2$—; —$CH_2(CH_3)$-CH—; —$CH_2CH_2CH_2CH_2$—, —$(CH_2)_5$—, etc.

A class of cyclic carbonates which are useful in the present invention is represented by the general formula VII

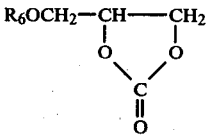

VII wherein $R_6$ is hydrogen or a monovalent hydrocarbon group. Examples of monovalent hyrocarbon groups include methyl, ethyl, propyl and butyl; cyclopentyl and cyclohexyl, phenyl and tolyl groups.

The preferred examples of the cyclic carbonates are ethylene carbonate and propylene carbonate. These carbonates preferably are reacted with a poly(ethyleneimine) having a molecular weight within the range of from about 200 to about 60,000.

The reaction between the poly(alkyleneimine) and the cyclic carbonate proceeds on mixing of the two reactants. A solvent is not required, but water, alcohols and mixtures of water with alcohols often are used as diluents to facilitate the reaction. Reaction will proceed at room temperature or the mixture may be heated to accelerate the reaction. Accordingly, reaction temperatures between about 20° and 100° C. may be useful. The amount of cyclic carbonate reacted with the poly(alkyleneimine) may be varied and, in general, the molar ratio of cyclic carbonate to poly(alkyleneimine) should be sufficient to provide up to one cyclic carbonate molecule for each hydrogen bonded to a nitrogen in the poly(alkyleneimine). Preferably, the weight ratio of poly(alkyleneimine) to cyclic carbonate will vary from about 10:1 to about 10:6. Higher amounts of cyclic carbonate may result in a product which is not completely soluble in the plating baths of the invention. Reaction times of about 0.5 to about one hour at the reflux temperature of the mixture are found to be sufficient although the reaction may be conducted for lesser or greater periods of time as desired depending on the particular reactants, the solvent (if any) and other reaction parameters.

The following examples illustrate the procedure for preparing the polymeric nitrogen-containing compounds useful in the plating baths of the invention. Unless otherwise indicated, all parts and percentages are by weight.

EXAMPLE 1

A mixture of ten parts of poly(ethyleneimine) having a molecular weight of about 300 and five parts of ethylene carbonate is prepared and heated with stirring to about 100° C. for 0.5 hour. Upon cooling, the reaction product solidifies. The solid product can be dissolved in water for further use.

EXAMPLE 2

A mixture of ten parts of poly(ethyleneimine) having a molecular weight of about 1,000 and three parts of ethylene carbonate in ten parts of water is heated at the reflux temperature for about 0.5 hour.

EXAMPLE 3

The procedure of Example 2 is repeated except that 20 parts of ethylene carbonate is used in the reaction mixture.

EXAMPLE 4

The procedure of Example 2 is repeated except that the ethylene carbonate is replaced by three parts of propylene carbonate.

EXAMPLE 5

A mixture of ten parts of poly(ethyleneimine) having a molecular weight of about 1,800, 30 parts of ethanol and three parts of ethylene carbonate is prepared and heated at the reflux temperature for about 0.5 hour.

EXAMPLE 6

A mixture of ten parts of poly(ethyleneimine) having a molecular weight of about 60,000, 20 parts of water and five parts of ethylene carbonate is heated at the reflux temperature for about 0.5 hour.

EXAMPLE 7

The procedure of Example 2 is repeated except that the poly(ethyleneimine) is replaced by ten parts of a poly(1,2-propyleneimine) having a molecular weight of about 2,000.

EXAMPLE 8

The procedure of Example 2 is repeated except that the ethylene carbonate is replaced by three parts of glycerol carbonate.

The polymeric nitrogen-containing compounds which are exemplified in Examples 1–8 are useful as brightening additive compounds for acid zinc electroplating baths. The amount of polymeric nitrogen-containing compound added to the acid zinc electroplating baths is an amount which is effective in producing a bright and generally level deposit of zinc. Depending on the particular plating bath and the nature of the other compounds contained in the bath, the brightening effective amount of the polymeric nitrogen-containing compositions of the invention may range from about 0.01 to about as much as 15 to 20 grams per liter of bath.

The plating baths of the invention will deposit a bright, level and ductile zinc deposit on substrates at any conventional temperature such as from about 20° to about 60° C., and more preferably, from about 20° to about 35° C.

The following Examples illustrate the aqueous acid zinc electroplating baths of the invention.

EXAMPLE A

| Component | g/l |
|---|---|
| Zinc chloride | 22.5 |
| Ammonium chloride | 150 |
| Sodium dimethynaphthalene monosulfonate (Available from Petrochemicals Co., Inc. under the general designation "Petro 22") | 1.5 |
| Sodium xylene monosulfonate (Available from ARCO Chemical Co. under the general designation "Ultrawet 40 SX") | 6.0 |
| Product of Example 2 | 1.0 |
| Sodium benzoate | 4.0 |
| Ortho-chlorobenzaldehyde | 0.1(100mg) |
| Beta-naphthol reacted with 12 moles of ethylene oxide | 3.0 |

EXAMPLE B

| | |
|---|---|
| Zinc chloride | 22.5 |
| Ammonium chloride | 150 |
| Sodium dimethylnaphthalene monosulfonate | 1.5 |
| Sodium xylene monosulfonate | 6.0 |
| Product of Example 2 | 1.0 |
| Sodium benzoate | 4.0 |
| Ortho-chlorobenzaldehyde | 0.05 |
| Carbowax 4000 | 4.0 |

EXAMPLE C

| | |
|---|---|
| Zinc chloride | 30 |
| Ammonium chloride | 150 |
| Sodium xylene monosulfonate | 12.0 |
| Product of Example 4 | 1.0 |
| Sodium salicylate | 4.0 |
| Ortho-chlorobenzaldehyde | 0.1 |
| Beta-naphthol reacted with 12 moles of ethylene oxide | 3.0 |

EXAMPLE D

| | |
|---|---|
| Zinc chloride | 15.0 |
| Ammonium chloride | 150 |
| Sodium dimethylnaphthalene monosulfonate | 1.5 |
| Product of Example 2 | 1.0 |
| Sodium benzoate | 4.0 |
| Ortho-chlorobenzaldehyde | 0.05 |
| Beta-naphthol reacted with 12 moles of ethylene oxide | 3.0 |

The efficacy of the above plating baths is determined by conducting plating tests in a 267 ml. Hull Cell at a given operating current. The plating baths prepared in Examples A–D tested in a Hull Cell produce a bright level zinc plate over a current density range of from below 0.3 amps/dm$^2$ to above 12 amps/dm$^2$.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the zinc plating bath to which the composition is added. Such amounts can be determined readily by one skilled in the art.

The following examples illustrate additive compositions or concentrates which may be prepared and utilized in accordance with the invention for preparing or maintaining the baths of the invention and/or improving the performance of the baths of the invention.

| Additive Composition 1 | Parts by Weight |
|---|---|
| Sodium dimethylnaphthalene monosulfonate | 3 |
| Sodium xylene sulfonate | 30 |
| Ortho-chlorobenzaldehyde | 0.2 |
| Water | 66.8 |
| Additive Composition 2 | |
| Sodium dimethylnaphthalene monosulfonate | 6.0 |
| Sodium xylene sulfonate | 30.0 |
| Beta-naphthol reacted with 12 moles of ethylene oxide | 7.5 |
| Product of Example 2 | 4.5 |
| Sodium benzoate | 9.0 |
| Water | 43.0 |
| Additive Composition 3 | |
| Sodium tetrahydronaphthalene monosulfonate | 6 |
| Sodium cumyl monosulfonate | 20 |
| Benzylidine acetone | 0.3 |
| Carbowax 4000 | 8.0 |
| Sodium benzoate | 7.0 |
| Water | 48.7 |
| Additive Composition 4 | |
| Sodium dimethylnaphthalene monosulfonate | 10 |
| Sodium cumyl monosulfonate | 20 |
| Ortho-chlorobenzaldehyde | 5 |
| Water | 35 |
| Methanol | 30 |

The embodiments of the invention which an exclusive property or privilege is claimed are defined as follows:

1. An aqueous acidic plating bath for the electrodeposition of a bright zinc deposit on a substrate which comprises (A) zinc ions, (B) ammonium ions, and (C) a mixture of aromatic sulfonic acids or salts thereof comprising at least one compound having the general formula

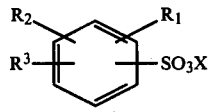

I and at least one compound having the general formula

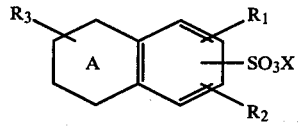

II wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring.

2. The plating bath of claim 1, wherein the alkyl groups are straight or branched chain alkyl groups containing up to about 6 carbon atoms.

3. The plating bath of claim 1, wherein the aromatic sulfonic acids or salts of formulas I and II contain at least two alkyl groups attached to the aromatic rings.

4. The plating bath of claim 1, wherein the mixture of aromatic sulfonic acid salts is a mixture of a dialkyl substituted benzene monosulfonate and a dialkyl naphthalene monosulfonate.

5. The plating bath of any of claims 1–4, wherein the bath also contains (D) at least one aromatic carbonyl-containing compound.

6. The plating bath of claim 5, wherein the aromatic carbonyl-containing compound is an aromatic aldehyde containing at least one halogen substituent.

7. The plating bath of claim 5, wherein the bath also contains (E) at least one polyoxyalkylated naphthol.

8. The plating bath of claim 7, wherein the polyoxyalkylated naphthol has the formula

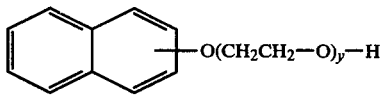

III wherein y is from about 6 to about 40.

9. The plating bath of claim 8, wherein the polyoxyalkylated naphthol is derived from a beta-naphthol.

10. The method of electrodepositing a bright zinc coating on a substrate which comprises electroplating said substrate in the aqueous acidic zinc bath of claim 7.

11. The plating bath of claim 5, wherein the bath also contains (F) a polyalkyleneimine.

12. The plating bath of claim 11, wherein the polyalkyleneimine is a polymeric nitrogen-containing compound prepared by reacting a poly(alkyleneimine) with a cyclic carbonate consisting of carbon, hydrogen and oxygen atoms.

13. The plating bath of claim 12, wherein the cyclic carbonate used in the preparation of the polymeric nitrogen-containing compound is phenylene carbonate or a cyclic carbonate having the general formula

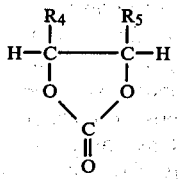

VI wherein $R_4$ and $R_5$ are each independently hydrogen, alkyl, $R_6OCH_2$—wherein $R_6$ is hydrogen or a monovalent hydrocarbon radical, and $R_4$ and $R_5$ taken together may represent an alkylene radical containing at least two carbon atoms.

14. The plating bath of claim 12, wherein the poly(alkyleneimine) is a poly(ethyleneimine).

15. The method of electrodepositing a bright zinc coating on a substrate which comprises electroplating said substrate in the aqueous acidic zinc bath of claim 11.

16. The method of electrodepositing a bright zinc coating on a substrate which comprises electroplating said substrate in the aqueous acidic zinc bath of claim 5.

17. The method of electrodepositing a bright zinc coating on a substrate which comprises electroplating said substrate in an aqueous acidic zinc bath according to any of claims 1–4.

18. An additive composition for an aqueous acidic zinc electroplating bath comprising a mixture of (a) at least one aromatic sulfonic acid or salt having the general formula

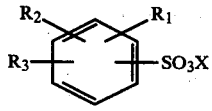

I (b) at least one aromatic sulfonic acid or salt having the general formula

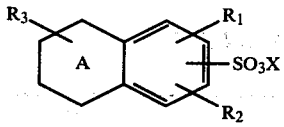

II wherein $R_1$, $R_2$ and $R_3$ are each independently hydrogen or lower alkyl groups, X is hydrogen, ammonia or any metal with the proviso that the metal sulfonate is soluble in the bath, and A is a saturated, unsaturated or aromatic ring, (c) at least one polyoxyalkylated naphthol or a polyalkylene glycol ether, and (d) an aromatic carbonyl-containing compound.

19. The additive composition of claim 18, wherein the aromatic carbonyl-containing compound is an aromatic aldehyde containing at least one halogen substituent.

20. The additive composition of claim 18, wherein $R_1$, $R_2$ and $R_3$ are straight or branched chain alkyl groups containing up to about 6 carbon atoms.

* * * * *